US008070664B2

(12) United States Patent
Rochat

(10) Patent No.: US 8,070,664 B2
(45) Date of Patent: Dec. 6, 2011

(54) DISPOSABLE DEVICE FOR THE CONTINUOUS CENTRIFUGAL SEPARATION OF A PHYSIOLOGICAL FLUID

(76) Inventor: Jean-Denis Rochat, Genolier (CH)

( * ) Notice: Subject to any disclaimer, the term of this patent is extended or adjusted under 35 U.S.C. 154(b) by 1077 days.

(21) Appl. No.: 11/814,587

(22) PCT Filed: Jan. 23, 2006

(86) PCT No.: PCT/CH2006/000049

§ 371 (c)(1),
(2), (4) Date: Jul. 24, 2007

(87) PCT Pub. No.: WO2006/079238

PCT Pub. Date: Aug. 3, 2006

(65) Prior Publication Data

US 2008/0153686 A1 Jun. 26, 2008

(30) Foreign Application Priority Data

Jan. 25, 2005 (EP) ..... 05405038

(51) Int. Cl.
*B04B 7/06* (2006.01)

(52) U.S. Cl. ..... 494/12; 494/41

(58) Field of Classification Search ..... 494/41, 494/43, 38, 56, 36, 12, 83–85
See application file for complete search history.

(56) References Cited

U.S. PATENT DOCUMENTS 2,963,219 A * 12/1960 Palmqvist et al. ..... 494/5
3,073,517 A * 1/1963 Pickels et al. ..... 494/67
3,317,127 A * 5/1967 Cole ..... 494/43
3,401,876 A * 9/1968 Lucas ..... 494/16
3,409,213 A * 11/1968 Latham, Jr. ..... 494/41
3,565,330 A * 2/1971 Latham, Jr. ..... 494/41

(Continued)

FOREIGN PATENT DOCUMENTS

DE 198 22 191 C1 8/1999

(Continued)

OTHER PUBLICATIONS

International Search Report of PCT/CH2006/000049, date of mailing Apr. 20, 2006.

*Primary Examiner* — Charles E Cooley
(74) *Attorney, Agent, or Firm* — Westerman, Hattori, Daniels & Adrian, LLP

(57) ABSTRACT

The invention relates to disposable device for the continuous centrifugal separation of a physiological fluid. The inventive device comprises: a fixed axial element; a centrifugation chamber which is mounted such that it can rotate around the axis of said element; an inlet channel for the blood to be centrifuged, the dispensing port of which is located close to the base of the chamber; and an outlet passage for a separated constituent, the inlet port of which is located close to the other end of the chamber in a concentrated area of one of the separated constituents having the lowest mass density in order for same to be removed continuously. The above-mentioned chamber takes the form of a long tube. The fixed axial element comprises a second outlet passage for a second of the separated constituents, the inlet port of which is located close to the end of the chamber opposite the above-mentioned base in a concentrated area of said second separated constituent having the highest mass density in order for same to be removed continuously.

12 Claims, 4 Drawing Sheets

U.S. PATENT DOCUMENTS

| | | | | | |
|---|---|---|---|---|---|
| 3,581,981 | A | * | 6/1971 | Latham, Jr. | 494/14 |
| 3,706,412 | A | * | 12/1972 | Latham, Jr. | 494/7 |
| 3,785,549 | A | * | 1/1974 | Latham, Jr. | 494/43 |
| 4,140,268 | A | * | 2/1979 | Lacour | 494/41 |
| 4,184,524 | A | * | 1/1980 | Lorenz | 141/392 |
| 4,300,717 | A | * | 11/1981 | Latham, Jr. | 494/41 |
| 4,684,361 | A | * | 8/1987 | Feldman et al. | 494/41 |
| 4,692,136 | A | * | 9/1987 | Feldman et al. | 494/38 |
| 4,767,396 | A | * | 8/1988 | Powers | 494/60 |
| 4,859,333 | A | * | 8/1989 | Panzani | 210/360.2 |
| 4,879,031 | A | * | 11/1989 | Panzani | 210/360.2 |
| 4,943,273 | A | * | 7/1990 | Pages | 494/41 |
| 4,983,158 | A | * | 1/1991 | Headley | 494/41 |
| 5,045,048 | A | * | 9/1991 | Kaleskas et al. | 494/41 |
| 5,100,372 | A | * | 3/1992 | Headley | 494/41 |
| 5,141,486 | A | * | 8/1992 | Antwiler | 494/37 |
| 5,312,319 | A | * | 5/1994 | Salter | 494/12 |
| 5,387,174 | A | * | 2/1995 | Rochat | 494/10 |
| 5,405,308 | A | * | 4/1995 | Headley et al. | 494/67 |
| 5,505,683 | A | * | 4/1996 | Geringer et al. | 494/12 |
| 5,514,070 | A | * | 5/1996 | Pages | 494/41 |
| 5,851,169 | A | * | 12/1998 | Meresz et al. | 494/12 |
| 5,882,289 | A | * | 3/1999 | Sakota et al. | 494/41 |
| 5,919,125 | A | * | 7/1999 | Berch | 494/67 |
| 6,123,655 | A | * | 9/2000 | Fell | 494/50 |
| 6,464,624 | B2 | * | 10/2002 | Pages | 494/36 |
| 6,629,919 | B2 | * | 10/2003 | Egozy et al. | 494/36 |
| 7,156,800 | B2 | * | 1/2007 | Panzani et al. | 494/1 |
| 7,186,230 | B2 | * | 3/2007 | Briggs et al. | 604/6.01 |
| 7,211,037 | B2 | * | 5/2007 | Briggs et al. | 494/44 |
| 2001/0027156 | A1 | * | 10/2001 | Egozy et al. | 494/37 |
| 2002/0032112 | A1 | * | 3/2002 | Pages | 494/36 |
| 2002/0142909 | A1 | * | 10/2002 | Sakota | 494/41 |
| 2003/0181305 | A1 | * | 9/2003 | Briggs et al. | 494/37 |
| 2006/0199720 | A1 | * | 9/2006 | Juan | 494/41 |
| 2008/0128367 | A1 | * | 6/2008 | Rochat | 210/782 |
| 2008/0132397 | A1 | * | 6/2008 | Rochat | 494/45 |
| 2008/0153686 | A1 | * | 6/2008 | Rochat | 494/45 |
| 2008/0264841 | A1 | * | 10/2008 | Rochat | 210/120 |
| 2009/0050579 | A1 | * | 2/2009 | Rochat et al. | 210/772 |
| 2010/0048373 | A1 | * | 2/2010 | Rochat | 494/41 |

FOREIGN PATENT DOCUMENTS

| | | | | |
|---|---|---|---|---|
| DE | 19822191 | C1 | * | 8/1999 |
| EP | 0 297 216 | A | | 1/1989 |
| EP | 297216 | A1 | * | 1/1989 |
| EP | 1 057 534 | A | | 12/2000 |
| JP | 56 166957 | A | | 12/1981 |
| JP | 56166957 | A | * | 12/1981 |
| JP | 59069166 | A | * | 4/1984 |
| JP | 09 192215 | A | | 7/1997 |
| JP | 09192215 | A | * | 7/1997 |
| JP | 2005081087 | A | * | 3/2005 |

* cited by examiner

DISPOSABLE DEVICE FOR THE CONTINUOUS CENTRIFUGAL SEPARATION OF A PHYSIOLOGICAL FLUID

FIELD OF THE INVENTION

The present invention relates to a disposable device for the continuous centrifugal separation of a physiological liquid, particularly blood, comprising a fixed axial input and output element about the axis of which a plastic centrifuging chamber is mounted such that it can rotate, an inlet pipe for the blood that is to be spun in the centrifuge passing longitudinally through said axial inlet and outlet element, its delivery opening lying near the bottom of said centrifuging chamber, an outlet passage for at least one separated constituent, its inlet opening lying near the opposite end of said chamber to said bottom and in a region where at least one of the separated constituents that has the lowest specific mass becomes concentrated so that it can be drawn off continuously, this passage passing through a longitudinal portion of said fixed axial inlet and outlet element, a rotary seal between said fixed axial element and said centrifuging chamber.

BACKGROUND OF THE INVENTION

Known separation buckets or bowls of this type are intended for semi-continuous separation, which entails gradually removing the plasma separated from the red blood cells and storing the red blood cells. The reason why the red blood cells are not removed from the separation chamber gradually as they become separated, as the plasma is, is because the tangential force applied to them is relatively high and the deceleration that would be experienced during a sudden transition into a fixed removal pipe would give rise to a high degree of hemolysis.

DESCRIPTION OF RELATED ART

Bowls such as this are described in many patents, among which mention may be made of U.S. Pat. No. 4,300,717 in which they appeared for the first time.

In order to remedy the disadvantages of this type of bowl, a bowl system exhibiting a flexible tube for supplying and removing the separated constituents of the blood has been proposed.

The system used to nullify the effect of the rotation of the centrifuging chamber on the attachment of the flexible pipe to this chamber in centrifugal separators of this type is disclosed in U.S. Pat. No. 3,586,413. This makes it possible, by forming an open loop, one end of which is secured in terms of rotation to the axis of the centrifuging bowl that rotates at the velocity $2\omega$ whereas its other end, coaxial with the first, is fixed while the open loop is driven at the velocity $\omega$, to cause the flexible tube rotating about its own axis to turn at the velocity $-\omega$, thus nullifying any torsion in the flexible tube.

This principle, which makes it possible to dispense with any seal between the flexible tube and the rotating member has been widely adopted in a great many centrifuging devices operating in continuous flow. This is because, unlike the case with centrifuges that have fixed feed and removal tubes, the separated components do not experience sudden deceleration in their tangential speed, which means that the risks of hemolysis are lower.

However, given the velocity at which the rotating member rotates in a centrifuge, the flexible tube rotating on itself at the velocity $-\omega$ is subjected to tensile stress caused by centrifugal force, to bending stress due to that portion of the tube that forms the open loop rotating on itself at the velocity $-\omega$, and to heating caused by the work of the viscous forces in the material as a result of the aforementioned bending. Now, when it is blood that is being centrifuged, the temperature must not exceed 40° C.

As a result, the rate at which the centrifuging bowl rotates is limited, which means that the diameter of this bowl cannot be too small otherwise separation quality will be adversely affected. Furthermore, the mechanism used to drive the bowl and the flexible tube is relatively complicated and expensive.

Another proposal, found in JP 09 192215 and in EP 0 297 216, is centrifugal separators comprising a rigid bell-shaped conical centrifuging bowl which are fed and from which the separated components are removed by fixed pipes positioned in an upper axial opening of the bowl. Given the bell shape of these chambers, it is not possible to cause the liquid that is to be separated to flow. This is because the heaviest phase, the red blood cells, remains in the largest-diameter part of the cone frustum.

Because of this shape of chamber, in JP 09 192215, the red blood cells are drawn off by a pipe the inlet of which lies more or less mid-way up the chamber, using a complex network of internal baffles. By contrast, the plasma is drawn off using this same complex network of baffles, using a pipe the inlet of which lies near the top of the chamber. As for the chamber in EP 0 297 216, the red blood cells are extracted by suction through a pipe the inlet of which is adjacent to the bottom of the chamber.

It can thus be seen that the existing solutions are unable to provide a satisfactory answer to the need for a simple compact separator that is easy to use, that can be used with good-value disposable centrifuging chambers in which the blood that is to be processed resides for the shortest possible length of time and which are able to operate at a good delivery rate.

This is why it has become necessary to reevaluate the design of the separation device in order to be able more satisfactorily to meet the aforementioned requirements.

It is an object of the present invention to overcome the aforementioned disadvantages, at least in part.

SUMMARY OF THE INVENTION

To these ends, a subject of the present invention is a disposable device for the continuous centrifugal separation of a physiological liquid, particularly blood, comprising:

- a fixed axial input and output element about the axis of which a plastic centrifuging chamber is mounted such that it can rotate,
- an inlet pipe for the blood that is to be spun in the centrifuge passing longitudinally through said axial inlet and outlet element, its delivery opening lying near the bottom of said centrifuging chamber,
- an outlet passage for at least one separated constituent, its inlet opening lying near the opposite end of said chamber to said bottom and in a region where at least one of the separated constituents that has the lowest specific mass becomes concentrated so that it can be drawn off continuously, this passage passing through a longitudinal portion of said fixed axial inlet and outlet element,
- a rotary seal between said fixed axial element and said centrifuging chamber, wherein this centrifuging chamber is of elongate tubular shape and its wall forms a flow and separation surface for the liquid that is to be separated, said fixed axial inlet and outlet element comprising a second outlet passage for at least a second of the separated constituents, its inlet opening lying near the opposite end of said chamber to said bottom and in a region of said flow where said second separated constituent that has the highest specific mass becomes concentrated so that it can be drawn off continuously.

The main advantage of this disposable device is its small volume and the fact that it allows continuous separation with fixed feed and removal pipes. The small volume makes it possible to reduce the cost of the disposable device and therefore also the volume of the centrifugal separator. A centrifuging chamber that has a small volume makes it possible to reduce the length of time for which the liquid that is to be separated is subjected to the separation forces, and therefore reduce the level of hemolysis and platelet activation.

Advantageously, the tubular centrifuge receptacle has a cylindrical narrowing at its upper end, to engage with guide rollers and in which a rotary seal is housed between the fixed axial element and the receptacle so as to keep the liquid being centrifuged sterile.

The small diameter of the cylindrical narrowing makes it possible to reduce the tolerance on this diameter by reducing the amount of shrinkage of the plastic, this degree of shrinkage being proportional to the size of the part. The fact that the rotary seal also operates on a small-diameter part means that the amount of heating can be reduced. Furthermore, the precision with which the centrifuging device is guided means that the seal can be used only for sealing rather than also for compensating for eccentricity of the rotary centrifuging chamber with respect to the fixed axial inlet and outlet element. As a result, the preload to which the seal needs to be subjected can be reduced to the minimum, that is to say that it is now dependent only on the conditions needed for sealing and therefore no longer constitutes a hybrid component, thus also making it possible to reduce the degree of heating.

Other specific features and advantages of the present invention will become apparent in the light of the description which follows and with the aid of the attached drawings which, schematically and by way of example, illustrate two embodiments of the disposable device for continuous centrifugal separation.

DESCRIPTION OF THE PREFERRED EMBODIMENTS

Figure 1:
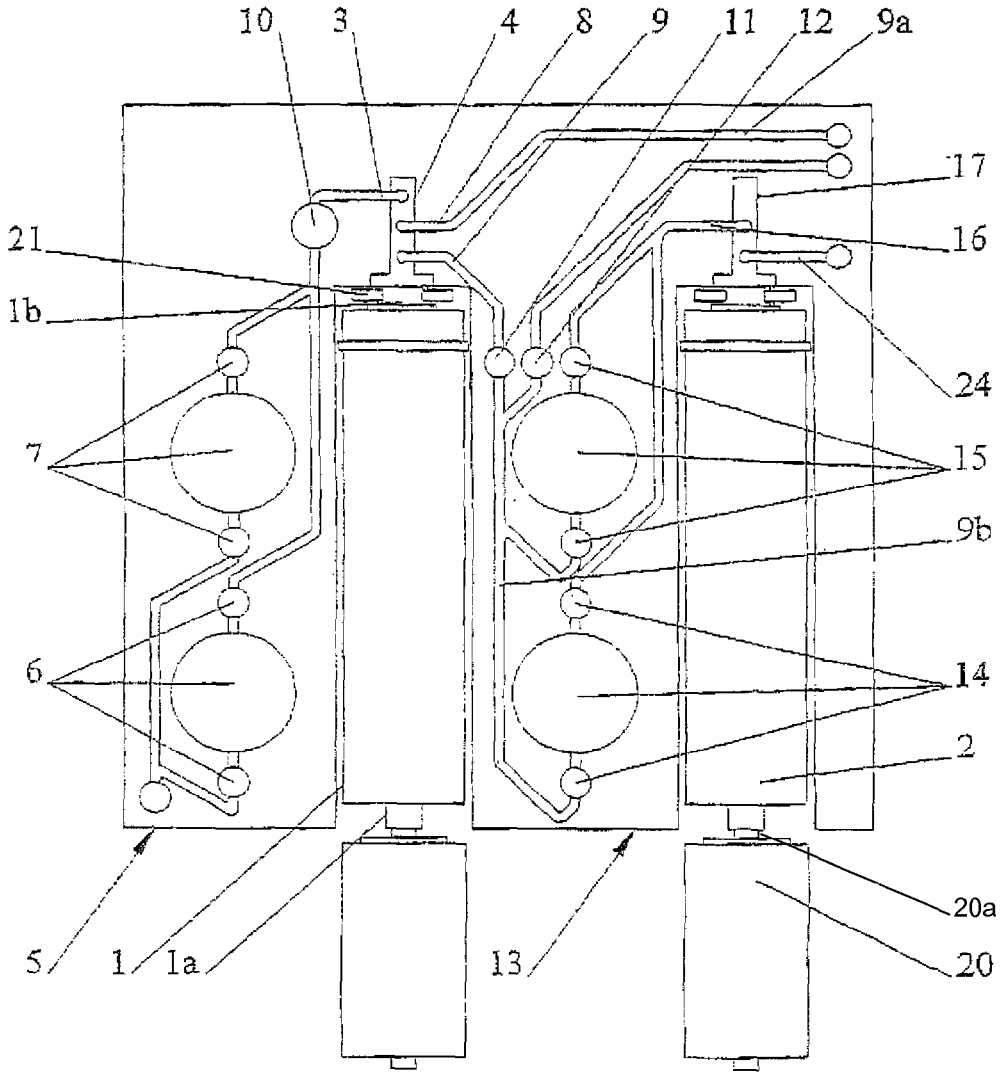
FIG. 1 is a front elevation of a centrifugal separator intended to use the device that forms the subject of the present invention.

The housing of the centrifugal separator intended to use the device according to the present invention and illustrated schematically by FIG. 1 comprises two elongate centrifuging chambers 1, 2 of tubular shape. The first tubular centrifuging chamber 1 comprises a feed tube 3 which is connected to the fixed axial inlet and outlet element 4 of the centrifuging chamber 1. This feed tube 3 is connected to a pumping device 5 which comprises two pumps 6 and 7 phase-shifted from one another by 180° so as to provide a continuous flow of physiological liquid, particularly blood. An air detector 10 is positioned along the feed tube 3.

Two outlet pipes 8, 9 are connected to the fixed axial element 4 to allow the continuous delivery of two constituents that have different densities of the physiological liquid. In the case of blood, the outlet pipe 8 is intended for delivering concentrated red blood cells RBC and the pipe 9 is intended for delivering platelet rich plasma PRP. This outlet pipe 9 comprises a valve 11 and splits into two branches 9*a*/9*b*. The branch 9*a* is used to collect the platelet concentrate and is controlled by a valve 12. The valves 11 and 12 operate using exclusive OR logic either to pass the PRP from the chamber 1 to the chamber 2 or to empty the platelet concentrate from chamber 2 to the outlet 9*a*. The branch 9*b* is used to lead the PRP to a pumping device 13 comprising two pumps 14 and 15 phase-shifted by 180° and used to provide a continuous feed to the second tubular centrifuging chamber 2 through a feed tube 16 connected to a fixed axial element 17 of the second tubular centrifuging chamber 2. An outlet pipe 24 for the platelet poor plasma PPP is also connected to the fixed axial element 17.

Figure 2:
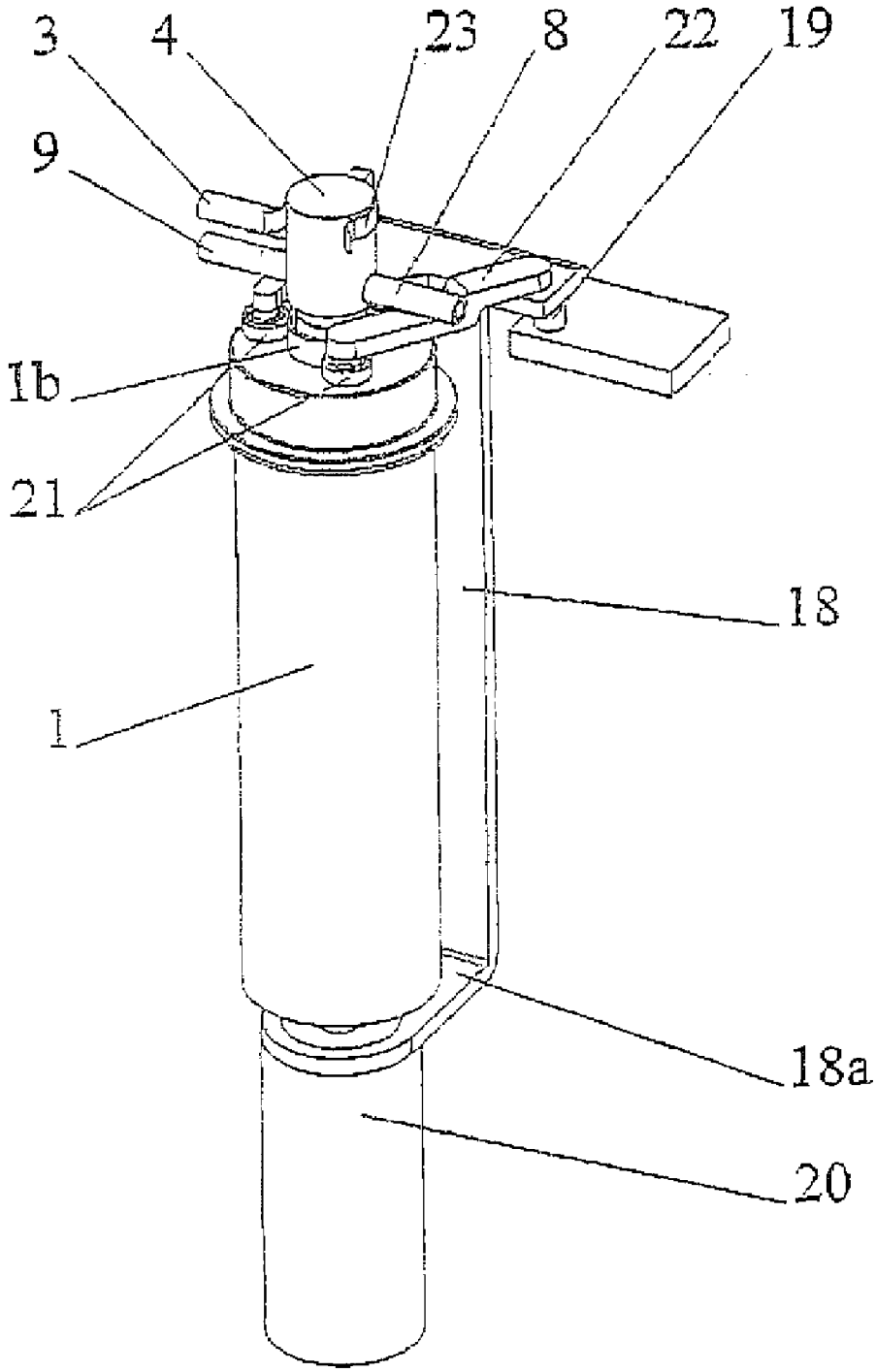
FIG. 2 is a partial perspective view of FIG. 1.

FIG. 2 depicts the way in which the tubular centrifuging chamber 1 is driven and guided. All the elements involved in driving and guiding the tubular centrifuging chamber are situated on one and the same support 18 connected to the casing of the centrifugal separator by an anti-vibration mount 19 of the silentbloc type. The support 18 has a vertical wall the lower end of which ends in a horizontal support arm 18*a* to which a drive motor 20 is attached. The drive shaft 20*a* of this motor 20 is of polygonal shape, for example having a Torx® profile, to complement an axial recess formed in a small tubular element 1*a* which projects underneath the bottom of the tubular centrifuging chamber 1. The drive shaft of the motor 20 and the tubular element 1*a* need to be coupled with extreme precision in order to ensure extremely precise guidance of this end of the tubular centrifuging chamber 1.

Figure 3:
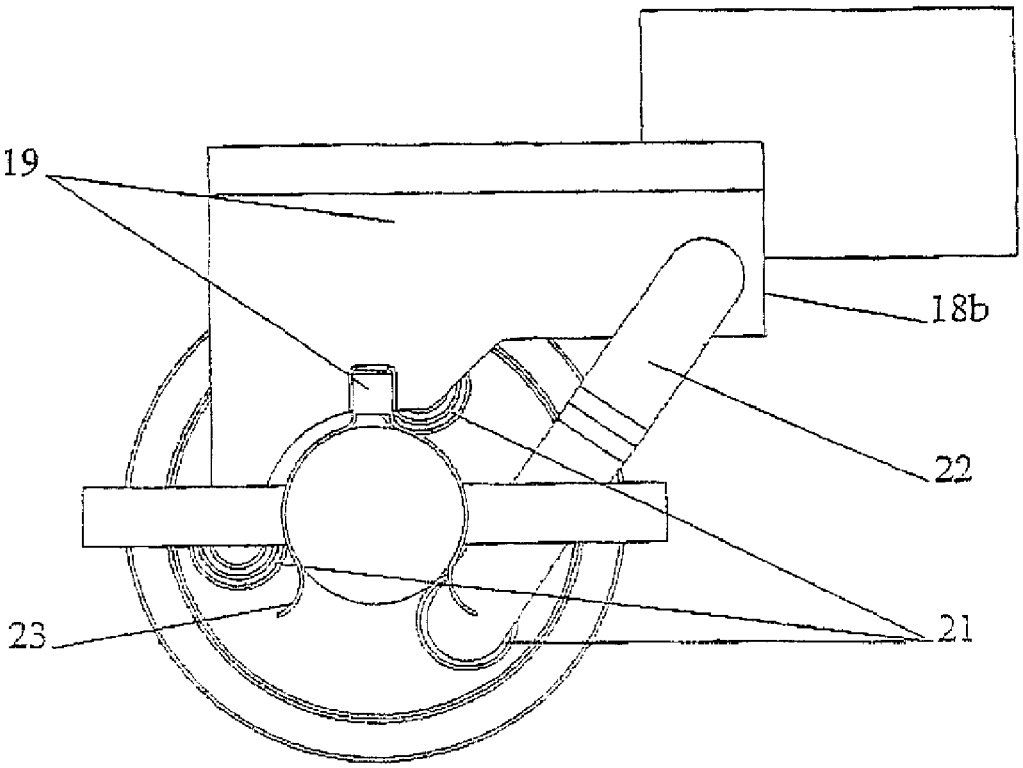
FIG. 3 is a view of FIG. 2 from above.

The upper end of the tubular centrifuging chamber 1 comprises a cylindrical axial guide element 1*b* of a diameter appreciably smaller than that of the tubular centrifuging chamber 1, projecting on its upper face. The cylindrical face of this element 1*b* is intended to engage with three centering rollers 21 that can be seen in particular in FIG. 3. One of these rollers 21 is secured to an arm 22 one end of which is mounted to pivot on an upper horizontal part 18*b* of the support 18. This arm 22 is subjected to the force of a spring (not depicted) or any other appropriate means intended to impart to it a torque that tends to cause it to turn in the clockwise direction with reference to FIG. 3, so that it bears elastically against the cylindrical surface of the cylindrical axial guide element 1*b*, so that the tubular centrifuging chamber can be fitted onto and removed from the support 18 by pivoting the arm 22 in the counterclockwise direction. A locking device for locking the angular position of the arm 22 in the position in which its roller 21 is pressing against the cylindrical surface of the cylindrical axial guide element 1*b* is provided, in order to avoid having excessive preload on the spring associated with the arm 22.

The land between the cylindrical axial guide element 1*b* and the upper end of the tubular chamber 1 is used, in collaboration with the centering rollers 21, as an axial end stop, preventing the drive shaft of the motor 20 from becoming uncoupled from the axial recess in the tubular element 1*a* projecting underneath the bottom of the tubular chamber 1.

Advantageously, the axes of rotation of the guide rollers 21 could also be inclined slightly by a few angular degrees, <2°, in respective planes tangential to a circle coaxial with the axis of rotation of the tubular centrifuging chamber 1 passing through the respective axes of rotation of the three rollers, in a direction chosen according to the direction in which the rollers rotate, in which these rollers apply a downward force on the tubular chamber 1.

An elastic centering and attachment element 23 for centering and attaching the fixed axial inlet and outlet element 4 of the tubular centrifuging chamber is secured to the horizontal upper part 18*b* of the support 18. This element 23 has two symmetrical elastic branches, of semicircular shape, each of which ends in an outwardly curved part intended to transmit to these elastic branches forces that allow them to separate from one another when the fixed axial inlet and outlet element 4 is introduced laterally between them.

As can be seen, all the elements for positioning and guiding the fixed and rotary parts of the tubular centrifuging chamber 1 are secured to the support 18 so that the precision is dependent on the precision of the support 18 itself, which can be manufactured with very tight tolerances especially since it is not a part that is complicated to manufacture. The other factors which contribute to guaranteeing good precision are the relatively long axial distance, due to the elongate tubular shape of the centrifuging chamber, between the lower guide and the upper guide. Finally, the fact that the cylindrical guide surface 1*b* is a small diameter surface makes it possible to reduce, on the one hand, the errors due to the shrinkage of the injected plastic from which the centrifuging chambers 1, 2 are manufactured, the shrinkage being proportional to the size, contrary to the case of a machined component and, on the other hand, out-of-round errors.

This precision with which the tubular centrifuging chamber is guided makes it possible to form very thin flows over the side wall of this centrifuging chamber. That makes it possible to have a small volume of liquid residing in the chamber, which is a factor able to reduce the risk of hemolysis and the risk of platelet activation, this risk admittedly being dependent on the forces applied, but also being dependent on the length of time for which the components of the blood are subjected to these forces. Thus, it is not possible to set a force threshold, because for a given force, the risk of hemolysis may be practically zero over a certain period of time, whereas it may be far greater, for the same force, but over an appreciably longer period of time.

As a preference, the tubular centrifuging chambers will have a diameter ranging between 10 and 40 mm, preferably of 22 mm and will be driven at a rate of rotation ranging between 5 000 and 100 000 rpm, so that the tangential speed to which the liquid is subjected does not exceed 26 m/s. The axial length of the tubular centrifuging chamber advantageously ranges between 40 and 200 mm, and is preferably 80 mm. Parameters such as these give a liquid flow rate ranging between 20 and 400 ml/min (particularly for dialysis), preferably 60 ml/min, which corresponds to a liquid residence time within the tubular chamber of 5 to 60 s, preferably 15 s.

We shall now look in greater detail into the design of the tubular centrifuging chamber 1 intended to be associated with the centrifugal separator just described. It can be specified here that everything explained in the foregoing description with regard to the dimensions, drive, position and guidance of the tubular centrifuging chamber 1 also applies to the tubular centrifuging chamber 2. By contrast, since the latter has only an outlet 24 for the PPP, its internal design is simpler than that of the tubular chamber 1.

Figure 4:
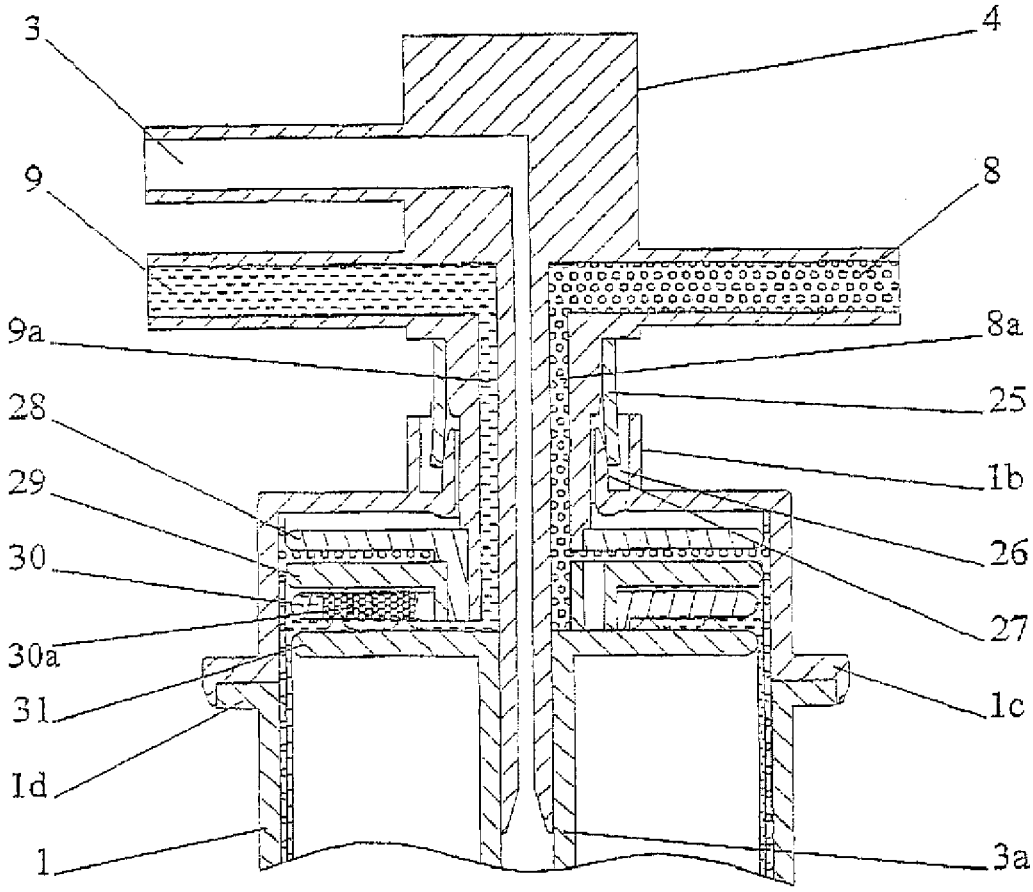
FIG. 4 is a part view in axial section and on a larger scale of the first embodiment of the disposable centrifuging device.

As illustrated by FIG. 4, the tubular chamber 1 is made of two parts which end in respective annular flanges 1*c*, 1*d* welded to one another. The interior space of the chamber is delimited by the essentially cylindrical wall of this chamber. The fixed axial inlet and outlet element 4 penetrates this tubular chamber 1 through an axial opening formed through the cylindrical axial guide element 1*b*. Sealing between this axial opening secured to the rotationally driven chamber and the fixed axial element 4 is achieved via a tubular seal 25 one segment of which is fixed to a cylindrical portion of this fixed axial inlet and outlet element 4, while another segment of it is inserted in an annular space 26 of the cylindrical axial guide element 1*b* and bears against a convex surface of the tubular wall 27 separating the axial opening through the cylindrical axial guide element 1*b* from the annular space 26. This seal keeps the liquid contained in the centrifuging chamber sterile. As illustrated in this FIG. 4, that part of the tubular seal 25 that bears against the tubular wall 27 experiences a small amount of radial deformation in order to make the seal.

It can be seen that the diameter against which the tubular seal 25 rubs is small and preferably <10 mm, so that the heating is limited to acceptable amounts. From the possible dimensions given hereinabove for the tubular centrifuging chamber, it can be seen that the axial distance between the upper and lower centering and guide means of this chamber is greater than five times the diameter of the cylindrical axial guide element 1*b*. Given the precision with which the tubular chamber 1 is guided and the precision that the relative positioning of the fixed axial inlet and outlet element 4 can achieve, the seal has practically no need to compensate for any eccentricity of the rotating tubular chamber 1, as it does in the aforementioned devices of the prior art which operate with semi-continuous flow. This also plays a part in reducing the heating of the rotating tubular seal 25 and therefore makes it possible to increase the rate of rotation of the tubular centrifuging chamber.

The fixed axial inlet and outlet element 4 comprises a tubular part 3*a* which extends the feed tube 3 connected to this fixed axial element 4 down close to the bottom of the tubular centrifuging chamber 1 towards which it can lead the blood or some other physiological liquid that needs to be separated.

The outlet pipes 8 and 9 connected to the fixed axial inlet and outlet element 4 each comprise an axial segment 8*a* and 9*a* respectively, which penetrates the tubular chamber and opens into that part of the fixed axial inlet and outlet element 4 that lies near the upper end of the tubular centrifuging chamber 1. The inlet end of each of these outlet pipes 8*a*, 9*a* is formed with a circular slot. Each of these slots is formed between two disks 28, 29 and 30, 31 respectively, which are secured to the fixed axial inlet and outlet element 4.

In this example, the radial distance between the edges of the disks 28, 29 and the side wall of the chamber 1 is less than the radial distance between the edges of the disks 30, 31 and this same side wall. Through this arrangement, the platelet rich plasma PRP, which is of lower density than the red blood cells RBC is sucked out into the outlet pipe 9 by the pumping device 13 (FIG. 1), whereas the red blood cells are sucked out into the outlet pipe 8 by the pressure gradient generated by centrifugal force within the liquid.

As can be seen, the diameter of that part of the tubular centrifuging chamber 1 that lies in the PRP and RBC outlet region where the disks 28 to 31 are located is slightly larger than that of the rest of this tubular chamber 1 so as to increase the respective thicknesses of the layers of PRP and RBC to make them easier to extract separately.

A dead space is formed between the adjacent disks 29 and 30. Its purpose is to trap leucocytes, the density of which is somewhere between that of the RBCs and of the platelets, but which are very much larger in size than the RBCs and the platelets. The disk 30 comprises a filter 30*a* to separate the leucocytes from the plasma and trap only the leucocytes in the dead space between the disks 29 and 30.

Figure 5:
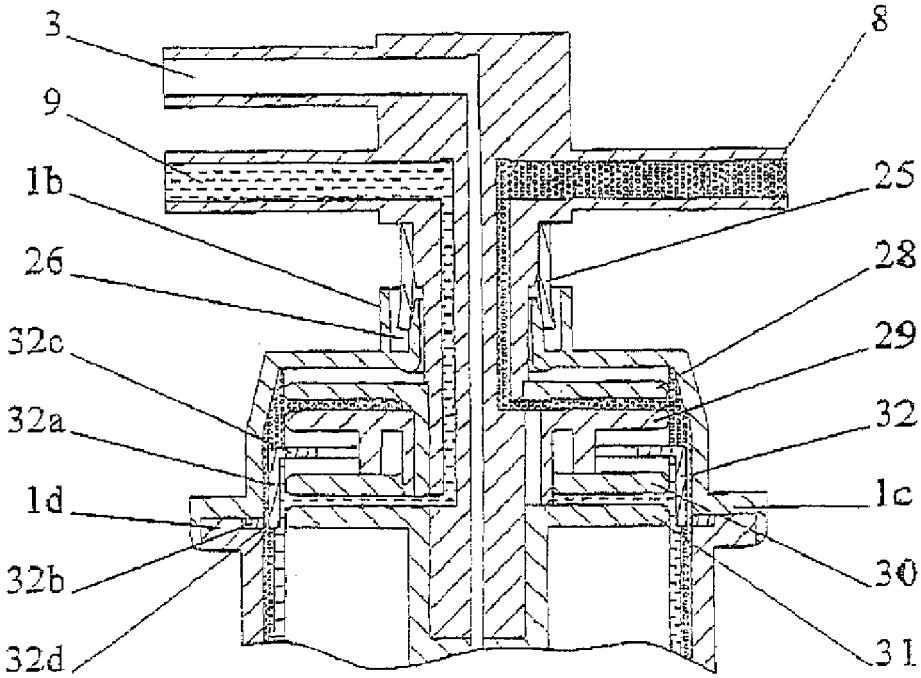
FIG. 5 is a view similar to FIG. 4 of a second embodiment of this device.

The second embodiment of the tubular centrifuging chamber as illustrated in FIG. 5 differs from that of FIG. 4 essentially through the presence of a barrier 32. This is of annular shape comprising a cylindrical part 32*a* situated facing the circular inlet opening for the PRP formed between the disks 30 and 31. The diameter of this cylindrical part 32*a* is chosen to fit in the space separating the edges of the disks 28, 29 from the side wall of the chamber 1 corresponding more or less to the diameter of the interface between the layers formed by the RBCs and the PRP. The two ends of this cylindrical part 32*a* end in flat rings 32*b*, 32*c*. The flat ring 32*b* extends out from the cylindrical part 32*a* while the flat ring 32*c* extends in to this cylindrical part 32*a*. The external flat ring 32*b* is housed in a recess in the annular flange 1*d* and is sandwiched between the two annular flanges 1*c* and 1*d*. This external flat ring 32*b* also has passing through it a number of openings 32*d* for the passage of the RBCs.

This barrier 32 has three roles to play. One is that of creating a physical barrier between the circular PRP inlet opening situated between the disks 30 and 31 and the RBCs, so as to prevent any risk that disturbances caused by the suction at the inlet opening might cause the RBCs and the PRP to recombine. A second role is that of allowing the RBCs to be collected on the same diameter as the plasma, thus reducing the hemolysis because the edges of the disks 30, 31 that form the outlet opening for the RBCs are less fully immersed in the layer of RBCs because all the disks 28 to 31 are of the same diameter. Finally, the third role is that of at least partially holding the leucocytes back inside the cylindrical part 32*a* of the barrier 32.

The rest of this tubular centrifuging chamber 1 according to this second embodiment is practically similar to the first embodiment just described. A leucocyte-stripping filter similar to the filter 30*a* of FIG. 4 may also be provided in order to trap the leucocytes between the disks 29 and 30.

The invention claimed:

1. A disposable device for the continuous centrifugal separation of a physiological liquid, particularly blood, comprising:

a fixed axial inlet and outlet element about the axis of which a centrifuging chamber is mounted such that it can rotate, an inlet pipe for the blood that is to be spun in the centrifuge passing longitudinally through said axial inlet and outlet element, a first outlet passage for at least a first separated constituent, wherein an inlet opening of said first outlet passage is located (i) near a top end of said chamber located opposite to a bottom of said centrifuging chamber and (ii) in a region where said first separated constituent that has the lowest specific mass becomes concentrated so that it can be drawn off continuously, this first outlet passage passing through a longitudinal portion of said fixed axial inlet and outlet element, a rotary seal between said fixed axial element and said centrifuging chamber, said fixed axial inlet and outlet element comprising a second outlet passage for at least a second separated constituent, wherein an inlet opening of said second outlet passage is located (i) near the top end of said chamber opposite to said bottom and (ii) in a region of said flow where said second separated constituent that has the highest specific mass becomes concentrated so that it can be drawn off continuously, wherein said centrifuging chamber is made of plastic and is of elongate tubular shape, the delivery opening of said inlet pipe being located near the bottom of said centrifuging chamber, so that a longitudinal wall of said centrifuging chamber forms a flow and separation surface for the liquid to be separated, wherein the longitudinal wall of said centrifuging chamber that forms a flow and separation surface for the liquid to be separated has substantially the shape of a cylinder generated by a straight line parallel to a main longitudinal axis of said cylinder.

2. The device as claimed in claim 1, in which the top end of said tubular centrifuging chamber comprises a cylindrical narrowing through which said fixed axial element passes and in which said rotary seal is positioned.

3. The device as claimed in claim 2, in which the external surface of said cylindrical narrowing is intended to engage with first guide means of said chamber, the bottom of said tubular centrifuging chamber having means for engaging with second guide, support and drive means of this chamber.

4. The device as claimed in claim 3, in which said centrifugal chamber is made of two parts which end in respective annular flanges welded to one another and the axial distance between the first guide means and the second guide, support and drive means of said centrifugal chamber is greater than five times the diameter of said cylindrical narrowing.

5. The device as claimed in claim 1, in which a leucocyte trap is positioned between the inlet openings of said first and second outlet passages and in that a filter element connects said trap to said outlet passage whose inlet opening lies near the opposite end of said receptacle to its bottom and at a radial distance from the side wall of said receptacle that corresponds to the region in which at least one of the separated constituents that has the lowest specific mass becomes concentrated.

6. The device as claimed in claim 1, in which said fixed outlet pipe the inlet opening of which lies in the region in which at least one of the separated constituents that has the lowest specific mass becomes concentrated is connected to a second centrifuging chamber.

7. The device as claimed in claim 1, in which the inlet openings of said outlet passages are two circular openings with the same diameter, an annular barrier lying facing the circular inlet opening of the phase of said liquid that has the lowest density, the diameter of said barrier lying in the space separating the circular inlet opening of said first passage from the side wall of the chamber corresponding more or less to the diameter of the interface between the layers formed by said first and second separated constituents.

8. The device as claimed in claim 1, in which the inlet end of said first outlet passage is formed with a first circular slot and the inlet end of said second outlet passage is formed with a second circular slot.

9. The device as claimed in claim 8, in which said first circular slot is formed between two first disks and second circular slot is formed between two second disks, said first and seconds disks being secured to said fixed axial inlet and outlet element.

10. The device as claimed in claim 9, in which the radial distance between the edges of said first disks and said wall of said centrifugal chamber is less than the radial distance between the edges of said second disks and said wall of said centrifugal chamber.

11. The device as claimed in claim 1, in which said physiological liquid is blood and a filter is provided to separate the leucocytes from the plasma and trap only the leucocytes.

12. The device as claimed in claim 1, wherein the cylindrical longitudinal wall extends substantially from an area of the delivery opening of the inlet pipe to an area of the inlet openings of the first and second outlet passages.

* * * * *